US005501093A

United States Patent [19]

Paakkunainen

[11] Patent Number: 5,501,093

[45] Date of Patent: Mar. 26, 1996

[54] PROCEDURE AND APPARATUS FOR FORMING A RECTANGULAR COLLAR AT THE END OF A PIPE

[75] Inventor: Matti Paakkunainen, Hyvinkää, Finland

[73] Assignee: GS-Hydro Oy, Hämeenlinna, Finland

[21] Appl. No.: 247,844

[22] Filed: May 23, 1994

[30] Foreign Application Priority Data

May 28, 1993 [FI] Finland ..... 932439

[51] Int. Cl.[6] ..... B21D 19/02

[52] U.S. Cl. ..... 72/123; 72/117

[58] Field of Search ..... 72/115, 117, 122, 72/123

[56] References Cited

U.S. PATENT DOCUMENTS

| | | | |
|---|---|---|---|
| 1,396,179 | 11/1921 | Foley | 72/123 |
| 1,775,766 | 9/1930 | Holmes | 72/117 |
| 2,840,136 | 6/1958 | Bellarts | 72/123 |
| 3,067,709 | 12/1962 | Conti et al. | 72/115 |
| 4,905,492 | 3/1990 | Lobakk . | |
| 5,345,801 | 9/1994 | Paakkunainen . | |

FOREIGN PATENT DOCUMENTS

| | | |
|---|---|---|
| 870799 | 2/1987 | Finland . |
| 73152 | 9/1987 | Finland . |
| 921627 | 4/1992 | Finland . |
| 355733 | 5/1973 | Sweden . |

*Primary Examiner*—Lowell A. Larson
*Attorney, Agent, or Firm*—Birch, Stewart, Kolasch & Birch

[57] ABSTRACT

A procedure and an apparatus for forming a rectangular collar at the end of a pipe (34) by shaping it includes a forming element (1) which is moved in the axial direction of the pipe towards the pipe and rotated along the interior surface of the pipe end about the longitudinal axis of the pipe. The forming cone (1) is moved in the axial direction of the pipe towards the pipe so that, as it moves towards the pipe, the forming element (1) is automatically turned from an initial position to a final position by the thrust producing the movement, simultaneously forming the pipe end so as to produce a collar substantially rectangular with respect to the direction of the longitudinal axis of the pipe.

18 Claims, 3 Drawing Sheets

PROCEDURE AND APPARATUS FOR FORMING A RECTANGULAR COLLAR AT THE END OF A PIPE

FIELD OF INVENTION

The present invention relates to a procedure and an apparatus for forming a rectangular collar at the end of a pipe by placing a forming element of a turning unit against the pipe end and moving the turning unit with the forming element in the axial direction of the pipe such that the forming element is rotated along an interior surface of the pipe end about the longitudinal axis of the pipe.

The invention concerns in the first place the making of a collar at the end of pipes made of steel or other metals, said pipes often having a diameter of several hundred millimeters and a wall thickness of several millimeters. For joining pipes together, a possible alternative is to form perpendicular flanges at the ends of the pipes to be joined, which are then coupled together. In the case of pipes that can be plastically worked up, the flange can be formed by suitably shaping the pipe end. However, if the pipe has a large diameter and a large wall thickness, a considerable force is needed for the shaping operation. Forming a collar on a pipe with a diameter of 200–400 mm requires a force of several thousand kilopond. In this case, the bearing elements transmitting the force constitute an important part of the functional whole.

DESCRIPTION OF THE BACKGROUND ART

In a previously known solution (patent application FI A 870799), a collar at an angle of 35°–40° is first formed at the pipe end, then the forming cone is replaced or an auxiliary forming head is mounted on it, whereupon a final rectangular collar is formed. The cone is held by its shaft in a chuck rotatably mounted on a frame. In another known device, the forming cone can be mounted at different positions in the chuck to permit the flanging pipes of different sizes. In the known solutions, the forming cone must be fitted anew between the first and second stages of the operation, and the cone is only supported by one end. Moreover, a separate fit is needed for each pipe size.

There is also another previously known solution (FI application no. 921627), in which a conical collar is first produced and the forming element is then moved in the axial direction of the pipe away from the pipe and turned so that its forming surface is substantially perpendicular to the longitudinal axis of the pipe, whereupon a rectangular collar is formed in a manner known in itself by moving the forming element in the axial direction of the pipe towards the pipe and rotating the forming element along the edge of the pipe end. The apparatus used in this solution is provided with means for turning the forming element about its fulcrum to a first position, in which the surface of the forming element is at an acute angle to the longitudinal axis of the pipe and the forming element is supported by a first surface bearing, and to a second position, in which the surface of the forming element is substantially at right angles to the longitudinal axis of the pipe and the forming element is supported by a second surface bearing. This solution requires an operator to turn the forming cone into two different positions.

Another previously known solution is the one described in Finnish patent publication no. 73152, in which a 90° collar is produced at the end of a pipe by means of a press mandrel. In this solution, the mandrel is pressed radially against the interior edge of the pipe end, requiring a large forming force and a robust mechanical structure, which increases the price of the apparatus.

Previously known is also a solution for forming a collar at the edge of a circular or elliptic metal plate, described in Swedish patent publication no. 355733. However, the device has a design that does not allow it to be used for the flanging of a pipe end.

SUMMARY OF THE INVENTION

The object of the present invention is to achieve a new procedure and apparatus which is fast and simple to operate and in which the drawbacks of the previously known solutions have been corrected. To accomplish this, the procedure of the invention is characterized by the turning unit with the forming element being moved in the axial direction of the pipe towards the pipe, so that as it moves toward the pipe, the turning unit with the forming element is automatically turned along a path with a circular arc from an initial position of substantially 45° to a final position by the thrust producing movement while simultaneously forming the pipe end so as to produce a collar substantially rectangular with respect to the direction of the longitudinal axis of the pipe.

The apparatus of the invention is characterized by a turning unit which accommodates the forming element and is so designed that it will turn during the forming phase along a generally circular path from an initial position of substantially 45° to a final position.

One of the advantages of the invention is that it provides a simple and automatic procedure for making a collar at the end of a pipe. Furthermore, the forming element can be moved to a position where its distance from the axis of the pipe corresponds to the pipe diameter and locked in this position by means of locking elements, which means that the same apparatus can be used for flanging pipes of different sizes.

Using the apparatus of the invention, a collar is formed on a pipe in a simple and efficient manner without intermediate mounting of the forming element between stages of the shaping operation. The tools used are generally large and heavy because of the material and dimensions of the pipes to be shaped, and replacing and mounting them would require a considerable deal of physical strength. As the apparatus of the invention uses only one forming element, the work becomes substantially easier. Besides, in this apparatus the axial force is transmitted to the object under shaping via parts properly supported.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described in detail by the aid of one of its embodiments by referring to the drawings which are given by way of illustration only, and thus are not limitative of the present invention and in which.

DETAILED DESCRIPTION OF THE PREFERRED EMBODIMENTS

Figure 1:
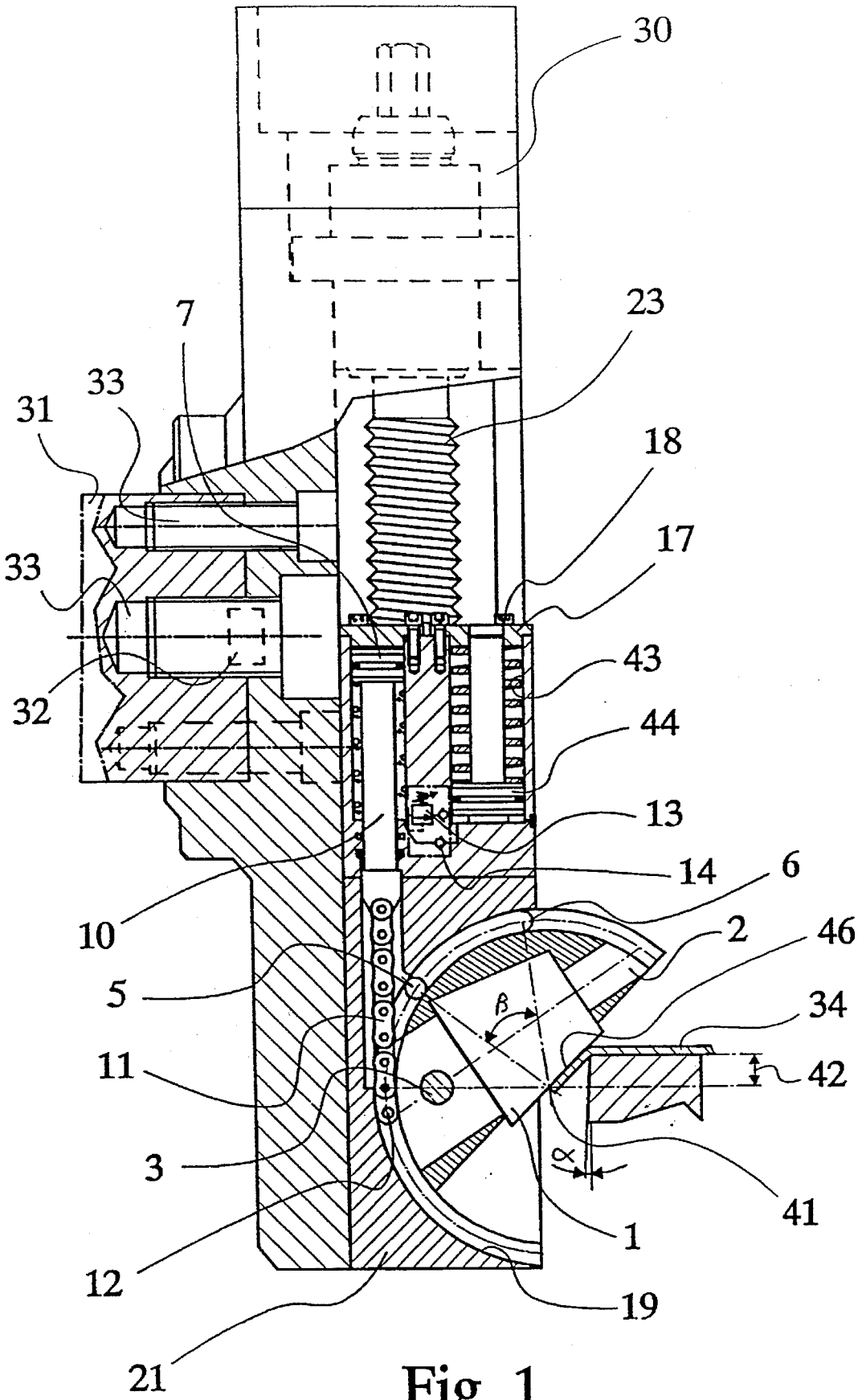
FIG. 1 presents a lateral view of the apparatus of the invention in its first position and partially sectioned.
Figure 2:
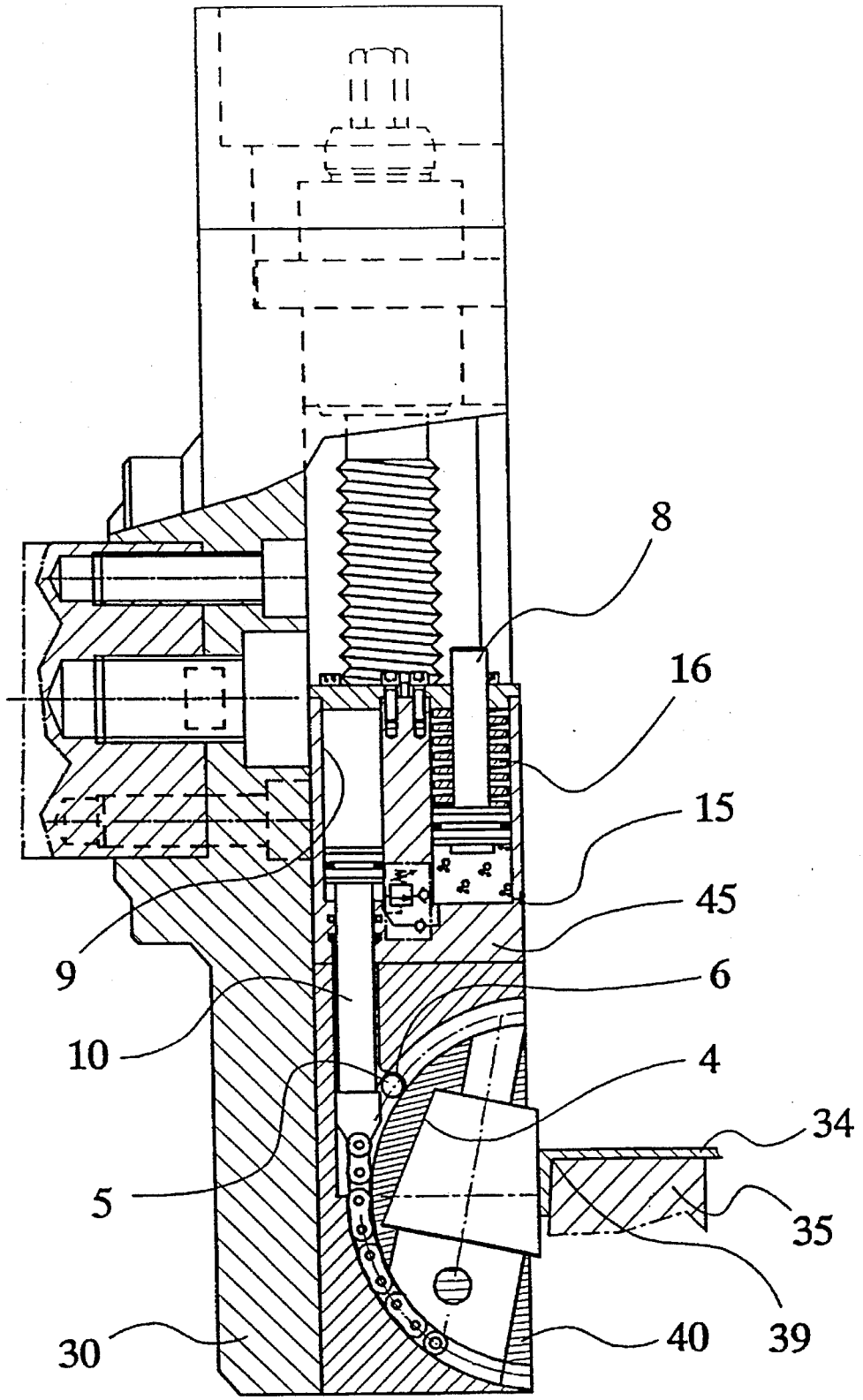
FIG. 2 presents a lateral view of the apparatus of the invention in a second position and partially sectioned.

FIG. 1 and 2 present a partially sectioned lateral view of the apparatus of the invention. The main parts of the apparatus are a stock 30, a sliding carriage 21 moving back and forth along guide tracks in the stock, a power unit 45 attached to the sliding carriage and a turning unit 40 with a forming cone 1 mounted in it.

The apparatus is coupled by means of a shaft 31 to a driving gear (not shown) which supports it and rotates the shaft about its central axis, depicted with a broken line and aligned with the longitudinal axis of the pipe 34 to be collared. During the shaping operation, the pipe 34 is held in place by a clamping jaw 35. The clamping jaw surface on the side facing towards the forming cone is not quite planar but differs from the plane perpendicular to the longitudinal direction of the pipe so that it forms a kind of truncated cone. In the planar section presented in FIG. 1, the angle $\alpha$ of deviation from the vertical plane is such that the inner circle of the clamping jaw is slightly farther removed from the front edge of the stock than its outer circle. A suitable angle of deviation is about 3°.

The driving gear also moves the shaft 31 in the direction of the central axis. Attached with bolts 33 to the end of the shaft 31 pointing away from the driving gear is a stock 30 acting as the frame of the apparatus. Fitted at the junction between the shaft 31 and the stock 30 is a wedge 32 receiving the torque. Mounted in the stock 30 is a sliding carriage 21 which is movable in the direction normal to the longitudinal axis of the pipe 34 and therefore in the direction normal to the axis of rotation of the apparatus, which is indicated with a broken line, i.e. in practice in a direction perpendicular to the longitudinal axis of the pipe. Fixed with screws 25 to the carriage 21 is a nut 24 for a conveyor screw 23 used to move the carriage as required by the pipe diameter along a guide track 22 provided in the stock 30.

Figure 4:
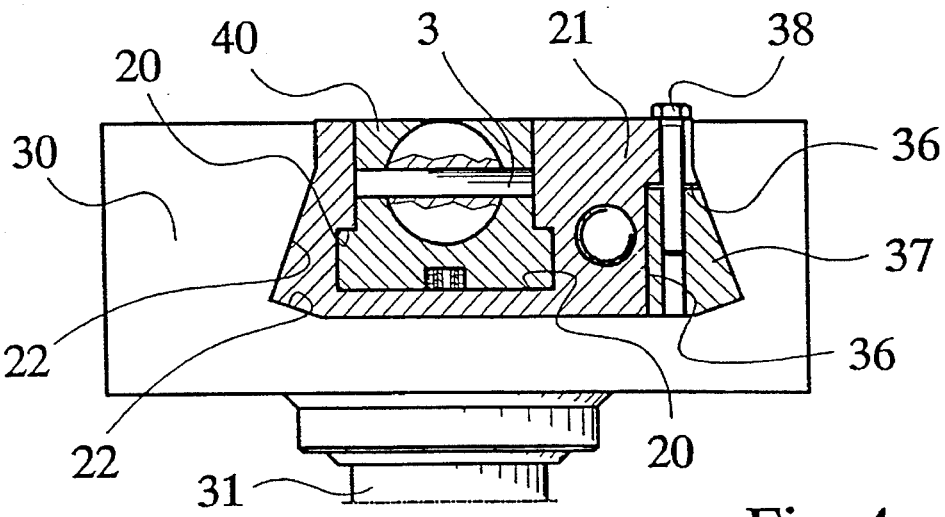
FIG. 4 presents the apparatus of the invention partially sectioned, seen from below.

On the side facing the pipe end to be shaped, the carriage has a recess 19 which, as seen from the side, has a substantially semi-circular form, with its straight side facing towards the pipe to be collared and the curved side towards the shaft 31. As shown in the sectional view in FIG. 4, on the bottom of the recess there are curved slots on each side of the recess, extending outwards. The slots act as sliding surfaces 20 for a turning unit 40, which also has a substantially semi-circular form in side view and has curved shoulders corresponding to the sliding surfaces on each side of it. The radius of curvature of the sliding surfaces and curved shoulders is substantially the same. The semi-circular recess housing the turning unit is referred to below as the chamber 19 of the turning unit.

One of the curved shoulders of the turning unit is provided with an equally curved motion limiter groove with semi-circular ends 6 which limits the turning motion. In FIG. 1, the free end of the limiter groove is indicated by reference number 6. The other end of the groove has reached a limiter pin 5, so the turning unit is now in its extreme position and cannot turn further outwards in this direction. The center of the radius of curvature of the limiter groove coincides with the center of the radius of curvature of the sliding surfaces 20 of the turning unit, i.e. it lies in that portion of the conical surface of the forming cone which is in contact with the pipe end being formed. The angle $\beta$ between the end points 6 of the limiter groove is 45°, permitting the forming of a collar from 45° to 90°.

The turning unit 40 further contains a case 4 for the forming cone, in which the forming cone 1 acting as a forming element is mounted. The forming cone 1 is a truncated cone whose conical surface constitutes the forming face which rolls along the pipe edge 34. The part constituting the forming face is rotatably mounted on a bearing axle 2 supporting the forming cone. At the wider end of the cone, the bearing axle 2 is interlocked with the turning unit 40 by means of a locking bolt 3. At the narrower end of the cone, the bearing axle of the cone forms a cylindrical projection protruding from the cone and having a radius smaller than that of the narrower end of the cone.

Attached with a joint pin 12 to that end of the turning unit which is closer to the wider end of the forming cone is the first end of a chain 11. The back edge of the turning unit is provided with a curved slot for the chain, in which slot the chain runs towards the central axis of the apparatus. The other end of the chain is attached to the rod 10 of a piston 7 so that the chain will move in its slot along with the movement of the piston 10 towards the central axis of the apparatus, thereby causing the turning unit to be turned towards the outer position depicted in FIG. 1. The piston 7 moves in a cylinder 9 which is mounted in the power unit 45 so that its longitudinal axis is aligned with the direction of movement of the sliding carriage 21.

The power unit, which is placed at that end of the sliding carriage which lies closer to the central axis of the apparatus, has yet another piston-and-cylinder assembly consisting of a cylinder 43 laid in a direction parallel to the longitudinal axis of the carriage 21 and a piston 44 with a piston rod 8, movable in the cylinder in its longitudinal direction. Inside the cylinder 43 there is a helical spring 16 placed around the piston rod between the back of the piston 44 and the end flange 17 of the cylinder. The end flange 17 has a central hole via which the piston rod 8 emerges through the end flange as the piston rises towards the end flange and the helical spring is compressed between the piston and the end flange. The end flange is fixed to the power unit by means of screws 18. That portion of the area of piston 7 to which the pressure of the oil used as pressure medium is applied is substantially smaller than the corresponding area of piston 44. Moreover, in cylinder 9 the oil volume is limited by the piston rod 10, so that when piston 7 moves through a certain distance, piston 44 will move through a much shorter distance, requiring only a short spring. This ratio also allows the required power transmission to be achieved.

Placed between cylinders 9 and 43 in the power unit is an outward relief valve 13 and a back pressure valve 14 through which the oil flows from one cylinder into the other. Cylinder 43 is provided with an oil supply hole 15 via which the power unit is filled with hydraulic oil.

In FIG. 1, the forming cone I is in its first position, where its forming face is essentially at an angle of 45° to the longitudinal axis of the pipe 34 while the turning unit 40 is in its outer position, retained by the limiter pin 5. Piston 7 is in its high position and piston 44 in its low position, pressed down by the spring 16. In FIG. 2, the forming cone 1 is in the final forming position, where it ends up after turning through 45° from the initial position, and is again retained by the limiter pin 5. Correspondingly, piston 7 is now in its low position and piston 44 has been forced up into its high position against the spring pressure 16 by the oil flowing through the outward relief valve 13.

Figure 3:
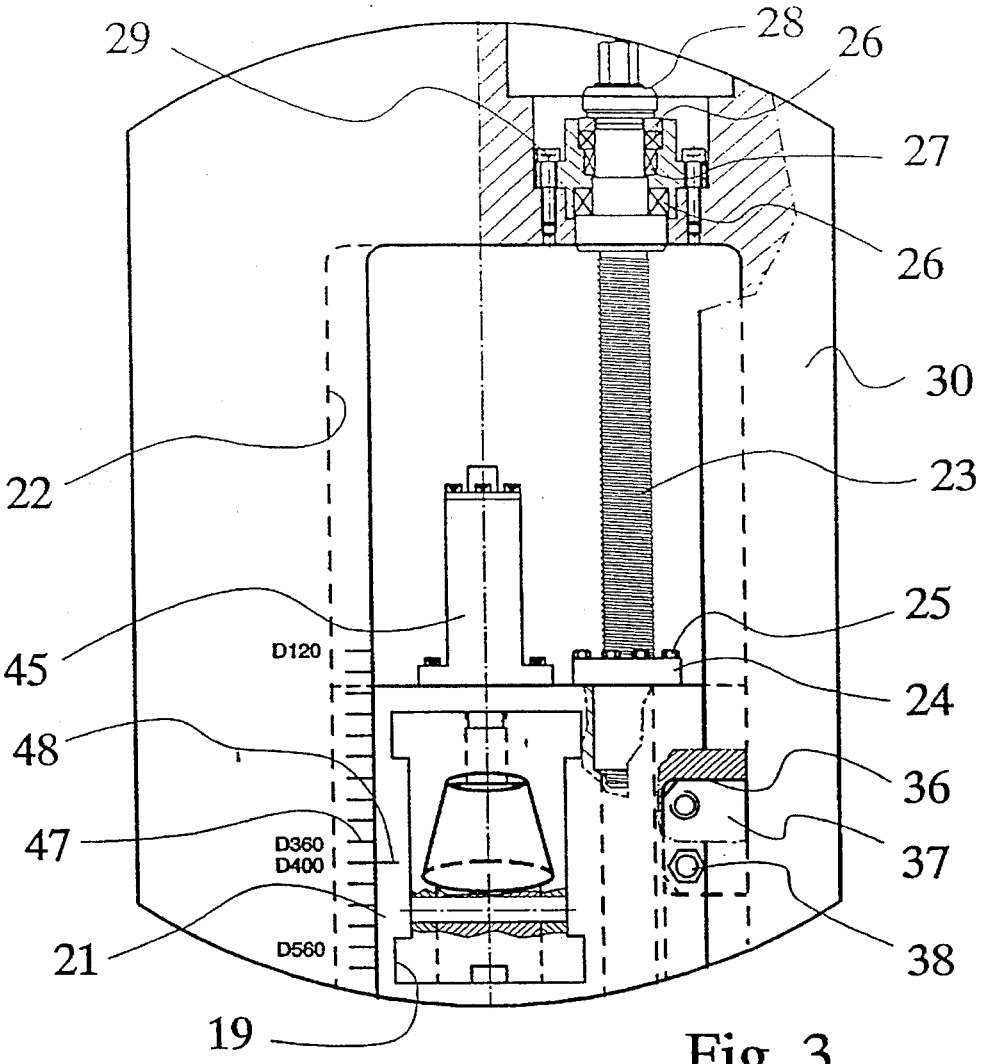
FIG. 3 presents the device of the invention as seen from the direction of the pipe and partially sectioned.

FIG. 3 depicts the apparatus as seen from the direction of the pipe and partially sectioned. The conveyor screw 23 is rotatably mounted by one end on the side of the stock 30 opposite to the carriage 21. The journal box of the conveyor screw is attached with fixing screws 29 to the stock 30 and the conveyor screw is mounted in the journal box by means of radial 27 and axial 26 thrust bearings. The bearing assembly is locked by a nut 28.

To allow the carriage 21 to be firmly fixed to the stock 30, the carriage is provided with a socket 36 placed on one side of the carriage, a wedge-shaped locking block 37 being fitted in the socket. As illustrated more clearly by FIG. 4, the locking block is tightened against the carriage and the guide track wall in the stock by means of screws 38 so that the carriage is pressed tightly against the opposite wall of the guide track. These locking elements keep the carriage and the forming cone mounted on it in the appropriate position, corresponding to the diameter of the pipe. The carriage and the stock are preferably provided with markings 48 and 47 indicating the carriage positions corresponding to different standard pipe diameters, thus making it easier to adjust the cone position as required for a given pipe size. The pipe diameter markings 47 in FIG. 3 are not shown in a real relation to each other, nor are some of the diameter values indicated necessarily real or in correct relation to each other.

According to the invention, the forming procedure is as follows. At the start of the operation, the forming cone 1 is in its initial position as shown in FIG. 1, controlled by the power unit 45. In this situation, the conical surface of the forming cone is at an angle of 45° to the longitudinal axis of the pipe as seen from the side, i.e. from the same direction as in FIG. 1. The pipe 34 to be collared is fixed in position by means of clamping jaws 35. If the forming cone 1 is not in the position corresponding to the pipe diameter, the carriage 21 is moved to the required position in relation to the central axis of the apparatus by turning the conveyor screw 23. The carriage is then secured in place by means of the locking block 37 by tightening the locking screws 38. If necessary, the setting of the outward relief valve 13 is adjusted according to the pipe size. Pipes with a larger diameter generally also have a larger wall thickness, which means that the forming resistance is increased and the outward relief valve has to be set to a higher value. Next, the shaft 31 and the forming cone 1 attached to it are moved towards the pipe in its axial direction by means of the driving gear. At the same time, the forming cone is rotated by the driving gear about the longitudinal axis of the pipe so that the conical surface of the forming cone rolls along the inner surface 46 of the pipe end. The whole stock 30 is now rotating. At first, the contact area between the conical surface and the pipe end is very narrow as only the inner corner of the pipe end touches the cone. As the forming operation advances, the contact area increases steadily until the forming cone is stopped by the clamping jaw 35 holding the pipe (FIG. 1), so that only a distance corresponding to the pipe wall thickness remains between the forming cone and the corner 39 of the clamping jaw. A conical collar (45°) has thus been formed and the first forming stage has been completed.

The shaft 31 and the forming cone 1 attached to it are moved further towards the clamping jaw 35 by the driving gear. The lever arm 42 between the corner point 39 of the clamping jaw and the fulcrum 41 of the forming cone 1 in the direction of the diametral plane of the pipe and the lever arm between the corner point 39 and the fulcrum 41 in the longitudinal direction of the pipe produce a deforming moment, subsequently termed simply bending moment. The bending moment tends to turn the forming cone. When the bending moment increases sufficiently, the outward relief valve 13 will admit the oil displaced by piston 7 into cylinder 43, where the helical spring 16 is compressed as piston 44 rises towards the end flange of the cylinder. At the same time, the turning unit 40 and the forming cone 1 moving with it are turned about the center of curvature of the turning unit, so that the forming cone gradually and steplessly forms a 90° collar at the end of the pipe. The turning motion continues through approximately 45° until the limiter pin 5 touches the other end 6 of the limiter groove. At this stage, the forming cone 1 is in its final position as shown in FIG. 2, in which the conical surface of the forming cone as seen from the side, i.e. from the same direction as in FIG. 2, is at right angles to the longitudinal axis of the pipe.

Once a rectangular collar has been produced, the shaft 31 is moved back in the direction away from the pipe. The spring 16 in cylinder 43 will now actuate piston 44, forcing the oil in this cylinder to flow through the back pressure valve 14 into cylinder 9 and piston 7 to move in the direction away from the carriage 21. The chain 11 attached to the end of the piston rod 10 of piston 7 moves along with the piston, causing the turning unit 40 and forming cone 1 to be turned back into the initial position, into an angle of 45°.

In the above, the invention has been described by the aid of one of its preferred embodiments. However, the presentation is not to be regarded as constituting a limitation, but the embodiments of the invention may vary freely within the limits defined by the claims presented below. Thus e.g. the element which in the power unit receives the bending moment can be implemented as an adjustable spring or equivalent instead of an outward relief valve 13, in which case the cylinders and pistons, too, can be replaced by corresponding machine elements. Similarly, the sliding guide tracks can be replaced e.g. with guide tracks producing a rolling resistance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method for forming a substantially rectangular collar at an end of a pipe, the pipe having a longitudinal axis and the method comprising the steps of:

placing a forming element of a turning unit against the pipe end;

moving the turning unit with the forming element in an axial direction of the pipe such that the turning unit and forming element are moved towards the pipe;

rotating the forming element along an interior surface of the pipe end about the longitudinal axis of the pipe;

moving the turning unit with the forming element in the axial direction of the pipe towards the pipe; and automatically turning the turning unit with the forming element along a generally circular path from an initial position of substantially 45° with respect to the longitudinal axis to a final position in response to thrust produced during movement of the turning unit and forming element towards the pipe while simultaneously deforming the pipe end so as to produce a collar substantially rectangular with respect to the direction of the longitudinal axis of the pipe.

2. The method according to claim 1, further comprising the step of adjusting a distance of the forming element from the longitudinal axis of the pipe prior to the step of rotating, the distance being adjusted in correspondence to a diameter of the pipe.

3. The method according to claim 2, further comprising the step of locking the forming element in position at a distance set after the step of adjusting.

4. The method according to claim 1, wherein the final position to which the turning unit with the forming element is moved is generally perpendicular to the longitudinal axis, the turning unit and forming element being moved 45° during the step of turning.

5. The method according to claim 1, further comprising the steps of:

moving the turning unit and the forming element generally perpendicularly with respect to the longitudinal axis to adjust a distance of the forming element from the longitudinal axis, the moving being prior to the step of rotating; and rotating the forming element about a turning axis which is generally perpendicular to the longitudinal axis of the pipe during the step of turning, the turning axis being located at a center of the generally circular path along which the forming element is turned during the step of turning.

6. An apparatus for forming a substantially rectangular collar at an end of a pipe, said apparatus comprising a forming element rotatably mounted on a supporting axle and a stock, the stock supporting the forming element either directly or indirectly and the stock being movable with respect to the pipe in a direction of a longitudinal axis of the pipe to bring a surface of the forming element into contact with an interior surface of the end of the pipe to thereby shape the end of the pipe, the apparatus further comprising a turning unit for accommodating the forming element, the turning unit being rotatable about a generally circular path from an initial position of substantially 45° with respect to the longitudinal axis to a final position in response to movement of the stock in the longitudinal direction toward the pipe during the shaping of the end of the pipe.

7. The apparatus according to claim 6, wherein movement of the turning unit along the circular path from the initial position to the final position is automatic and in response to engagement of the end of the pipe with the turning unit and continued movement of the stock in the longitudinal direction of the pipe.

8. The apparatus according to claim 6, wherein the turning unit is rotated 45° during the step of turning.

9. The apparatus according to claim 6, wherein the stock with the forming element and turning unit are all rotatable about the longitudinal axis of the pipe.

10. The apparatus according to claim 6, further comprising a carriage in which the turning unit is rotatably mounted on the supporting axle, the carriage being movable within the stock and the apparatus further comprising means for moving the carriage with the forming element toward and away from the longitudinal axis of the pipe such that a distance of the forming element from the longitudinal axis is adjustable in correspondence to a diameter of the pipe.

11. The apparatus according to claim 10, further comprising means for locking the carriage at a fixed distance from the longitudinal axis of the pipe.

12. The apparatus according to claim 11, wherein the means for locking includes a locking block with locking screws mounted on the carriage, the locking block being selectively engagable with the stock to hold the carriage in position.

13. The apparatus according to claim 10, wherein the means for moving the carriage including a rotatable screw operatively mounted between the stock and the carriage.

14. The apparatus according to claim 6, wherein the turning unit includes a case for the forming cone, the forming element being a truncated cone with a conical surface for engaging the interior surface of the end of the pipe, the axle being mounted in the case and being interlocked with the turning unit.

15. The apparatus according to claim 14, further comprising a power unit and a chain, the chain being operatively connected to the turning unit and to the power unit, the power unit including at least one piston and cylinder unit attached to the chain, the chain being pulled by the at least one piston and cylinder unit for moving the turning unit along the generally circular path from the final position to the initial position.

16. The apparatus according to claim 15, wherein the turning unit is rotatable about a turning axis during movement along the generally circular path, the turning axis being generally perpendicular to the longitudinal axis of the pipe.

17. The apparatus according to claim 15, wherein two piston and cylinder units are provided in the power unit, a first piston and cylinder unit being the piston and cylinder unit attached to the chain and a second piston and cylinder unit being hydraulically connected to the first piston and cylinder unit.

18. The apparatus according to claim 6, wherein the turning unit is rotatable about a turning axis during movement along the generally circular path, the turning axis being generally perpendicular to the longitudinal axis of the pipe.

* * * * *